US008845342B2

(12) United States Patent
De Souza

(10) Patent No.: US 8,845,342 B2
(45) Date of Patent: Sep. 30, 2014

(54) CONNECTION DEVICE FOR POWERING ELECTRICAL EQUIPMENT

(75) Inventor: Stephane De Souza, Les Essarts le Roi (FR)

(73) Assignee: Valeo Systemes Thermiques, Le Mesnil Saint Denis, Cedex (FR)

( * ) Notice: Subject to any disclaimer, the term of this patent is extended or adjusted under 35 U.S.C. 154(b) by 152 days.

(21) Appl. No.: 13/518,740

(22) PCT Filed: Dec. 15, 2010

(86) PCT No.: PCT/EP2010/069817

§ 371 (c)(1),
(2), (4) Date: Nov. 15, 2012

(87) PCT Pub. No.: WO2011/076638

PCT Pub. Date: Jun. 30, 2011

(65) Prior Publication Data

US 2013/0059483 A1 Mar. 7, 2013

(30) Foreign Application Priority Data

Dec. 23, 2009 (FR) ..... 09 06305

(51) Int. Cl.
*H01R 13/648* (2006.01)

(52) U.S. Cl.
USPC ..... 439/98

(58) Field of Classification Search
USPC ..... 439/98, 99
See application file for complete search history.

(56) References Cited

U.S. PATENT DOCUMENTS

| | | | | |
|---|---|---|---|---|
| 6,398,563 | B1 * | 6/2002 | Kanagawa et al. | 439/98 |
| 6,558,172 | B2 * | 5/2003 | Kanagawa | 439/98 |
| 6,814,617 | B2 * | 11/2004 | Oota et al. | 439/589 |
| 6,815,610 | B2 * | 11/2004 | Kuboshima et al. | 174/360 |
| 8,118,613 | B2 * | 2/2012 | Rapp et al. | 439/585 |

FOREIGN PATENT DOCUMENTS

| | | |
|---|---|---|
| EP | 1045476 A2 | 10/2000 |
| EP | 1168524 A2 | 1/2002 |

OTHER PUBLICATIONS

International Search Report for Application No. PCT/EP2010/069817 dated Mar. 31, 2011, 5 pages.

* cited by examiner

*Primary Examiner* — Gary Paumen
(74) *Attorney, Agent, or Firm* — Howard & Howard Attorneys PLLC

(57) ABSTRACT

The invention relates to a connection device for powering electrical equipment, said connection device comprising: a first electrical conductor (3) configured such that it is electrically connected to an electrical power source, and a second electrical conductor (5) connected mechanically and electrically to the electrical equipment to be powered. According to the invention, said connection device comprises an electrically insulating overmolding (7) held mechanically, covering the first (3) and second (5) electrical conductors at the connection thereof.

12 Claims, 2 Drawing Sheets

CONNECTION DEVICE FOR POWERING ELECTRICAL EQUIPMENT

RELATED APPLICATIONS

Figure 1:
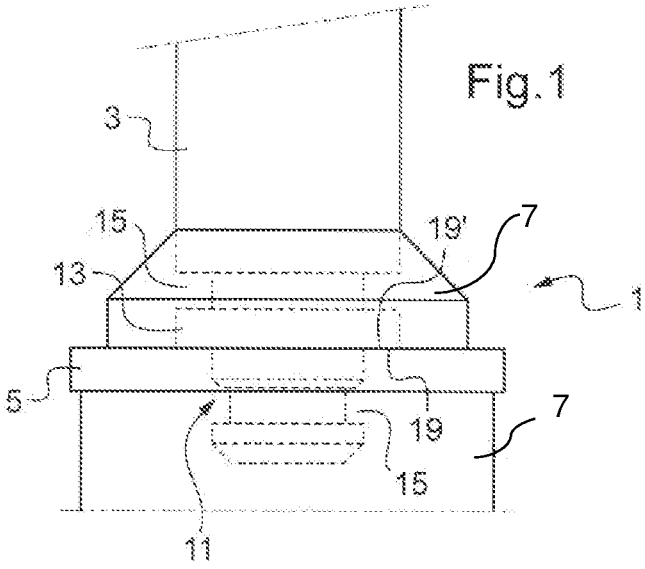

This application claims priority to and all the advantages of International Patent Application No. PCT/EP2010/069817, filed on Dec. 15, 2010, which claims priority to French Patent Application No. FR 09/06305, filed on Dec. 23, 2009.

The invention concerns a connection device for powering electric equipment, such as an electrical heating device of a heater and/or air conditioner for motor vehicles.

Such an electric heating device, also known as an electric radiator, is generally mounted in a conduit for circulation of air to be heated downstream of a heat exchanger for heating air for heating the passenger compartment of a motor vehicle, as well as demisting and deicing, by exchange of heat between a flow of air through the heat exchanger and a liquid, generally the engine cooling liquid.

The electric heating device includes heater modules disposed in such a manner as to be exposed directly to the air passing through the heating device to provide a virtually immediate top-up of heat if heating by the heat exchanger is insufficient.

The electric heating device is operated temporarily, until the heat exchanger can heat the air in the required manner on its own.

Electric equipment for motor vehicles such as the electric heating device is generally powered via electric conductors connected on the one hand to an electric wiring harness and on the other hand to the electric equipment to be powered.

In a known solution, these electric conductors comprise an electric wiring harness connector electrically connected to an electrical power supply and a metal plate also known as a "busbar" generally provided on the electric equipment to be powered and electrically connected to that equipment.

To distribute the energy in the electric equipment to be powered, the metal plate is electrically and mechanically connected to the electric wiring harness connector.

This connection is conventionally effected by crimping or by a force-fit of the connector on the metal plate.

However, there is a risk of the connector being disconnected from the metal plate, for example in the event of a force being applied to the connector.

The invention therefore has the objective of alleviating this drawback of the prior art by proposing a connection device enabling the mechanical connection between these two electric conductors to be strengthened.

To this end, the invention provides a connection device for powering electric equipment, said connection device comprising:

- a first electric conductor configured to be electrically connected to an electric power supply, and
- a second electric conductor mechanically and electrically connected to the first electric conductor and configured to be electrically connected to the electric equipment to be powered,
  - characterized in that said connection device includes an electrically insulative mechanical retention overmolding enveloping the first and second electric conductors at the level of their connection.

Such an overmolding enables the connection between the two electric conductors to be strengthened. The electric conductors conjointly surrounded by overmolded plastic material are able to withstand higher forces than in the prior art without becoming detached, as on connection to or disconnection from the electric counterpart, for example the wiring harness of a motor vehicle.

Said connection device may further have one or more of the following features, separately or in combination:

- said overmolding is produced in a rigid plastic material,
- said electric conductor includes at least one translation blocking cavity filled by said overmolding.
- said at least one cavity is a peripheral groove,
- the second electric conductor is produced in the form of a metal plate including an opening in which is received a complementary end of the first electric conductor,
- the first electric conductor has a substantially cylindrical general shape,
- the first electric conductor includes a connecting flange having a connection surface cooperating with a corresponding connection surface provided on said second conductor,
- the second electric conductor has a predetermined number of rotation blocking orifices filled by said overmolding,
- the rotation blocking orifices have a substantially oblong general shape,
- the electric equipment to be powered is an electric heating device for motor vehicles,
- said overmolding is produced in a plastic material configured to resist the high operating temperatures of said heating device.

Figure 2:
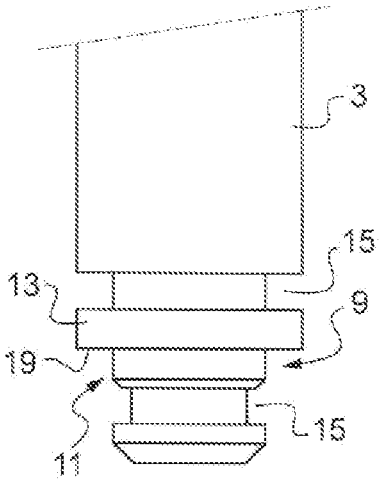
Figure 3:
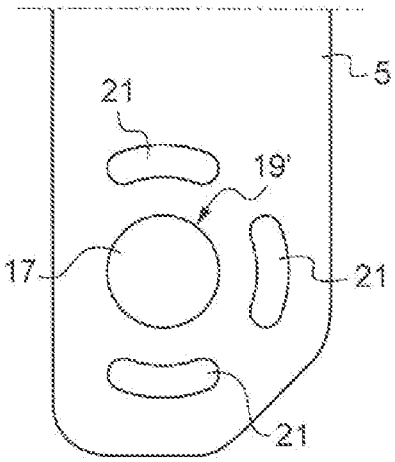
Figure 4A:
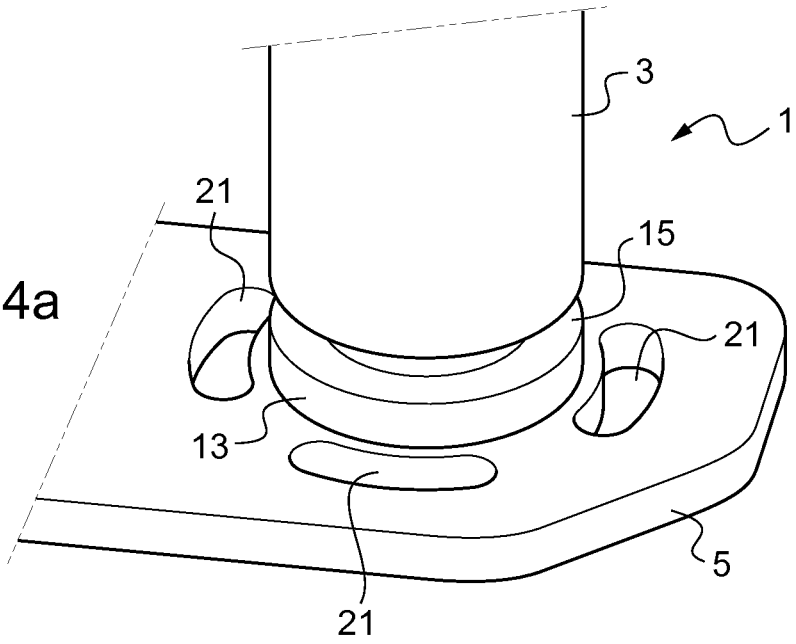
Figure 4B:
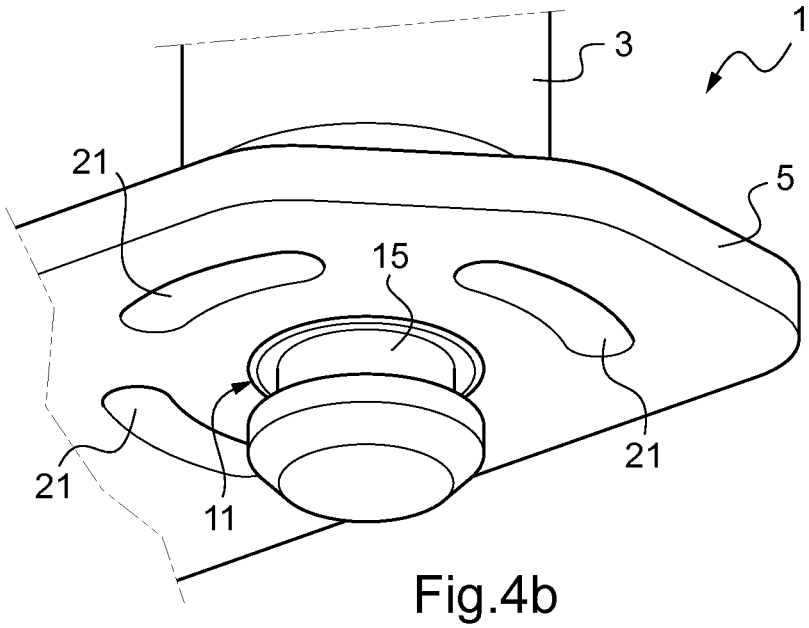

Other features and advantages of the invention will become more clearly apparent on reading the following description, given by way of illustrative and nonlimiting example, and from the appended drawings in which:

FIG. 1 is a partial diagrammatic representation of a connection device of the invention, FIG. 2 is a partial representation of a first electric conductor of the FIG. 1 connection device, FIG. 3 is a partial representation of a second electric conductor of the FIG. 2 connection device, FIG. 4*a* is a partial perspective view of the first conductor from FIG. 2 assembled to the second conductor from FIG. 3, and FIG. 4*b* is a rear perspective view of FIG. 4*a*.

In these figures, substantially identical elements bear the same references.

There is partially represented in FIGS. 1*a* and 1*b* a connection device 1 for powering electric equipment (not shown), such a device for electrically heating the air in a motor vehicle, the heated air being conveyed toward heating and demisting/deicing vents so as to be selectively distributed in the passenger compartment according to the positions of mixing and distribution valves.

The connection device 1 includes:

- a first electric conductor 3 shown partially and in dashed outline, such as an electric wiring harness connector, so as to be electrically connected to an electric power supply available in the vehicle for example, such as the battery,
- a second electric conductor 5 carried for example by a casing of the electric equipment to be powered (not shown) to be electrically connected to that equipment and electrically and mechanically connected to the first conductor 3 in order to conduct energy in the equipment, and
- a mechanical retention overmolding 7 enveloping the first and second electric conductors 3 and 5 at the level of their connection.

In the example shown, the first electric conductor 3 is produced in the form of a cylinder. This cylinder shape is complementary to the electrical wiring harness of the vehicle. Any other shape may be envisaged of course.

As seen in FIG. 2, the cylinder 3 has at one end 9 cooperating with the second conductor 5:

a smaller portion 11, a connecting flange 13, and one or more translation blocking cavities, produced here in the form of peripheral grooves 15.

This end 9 thus has a shape adapted for connection with the second conductor 5.

Referring to FIG. 3, the second conductor 5 is for its part produced in the form of a metal plate 5 also known as a busbar. This metal plate 5 includes an opening 17, circular in this example, to receive the smaller portion 11 (FIGS. 2, 3). To this end, the smaller portion 11 of the cylinder 3 has a diameter less than the opening 17 in the plate 5.

On the other hand, the connecting flange 13 has a diameter greater than that of the opening 17, so that when the cylinder 3 is assembled with the plate 5 (FIGS. 4*a*, 4*b*) the smaller portion 11 passes through the opening 17 until the flange 13 abuts against the plate 5. The connection surface 19 of the flange 13 is then in contact with an associated connection surface 19' on the plate 5 around the opening 17 (FIGS. 1 to 3).

Moreover, two grooves 15 are produced on the cylinder 3 upstream and downstream of the connecting flange 13. Accordingly, when an electrically insulative material is overmolded at the level of the connection between the cylinder 3 and the plate 5 to form the mechanical retention overmolding 7, this material is inserted into the two grooves 15 on either side of the plate 5, which blocks movement in translation of the cylinder 3 relative to the plate 5.

Moreover, as seen in FIG. 1, the overmolded material may completely envelope the end portion 9 of the cylinder downstream of the plate 5 for better retention.

Referring to FIGS. 3 to 4*b*, there may further be provided on the plate 5 rotation blocking orifices 21, three orifices 21 in the example shown. These orifices are disposed around the opening 17 and have an oblong general shape for example, which may be curved, i.e. substantially kidney-shaped. During overmolding, the overmolded material is also inserted into these orifices 21, which blocks relative rotation of the cylinder 3 and the plate 5.

The overmolding 7 then creates a solid assembly and retains the two conductors 3 and 5 in position to guarantee a permanent connection.

The material used for the overmolding is a rigid plastic material such as a thermostable thermoplastic polymer chosen from the group comprising i) saturated polymers, such as poly(cyclohexylene dimethylene terephthalate), ii) polyphthalamides, preferably up to 30% charged with glass fibers, iii) amorphous semi-aromatic polyamides, such as polytrimethyl hexamethylene terephthalamide, to confer the required mechanical strength. If the equipment to be powered is an electric heating device, this material must also resist the high temperatures, of the order of 250 to 260° C., at which such a device operates.

It is thus clear that such an overmolding 7 guarantees the connection between the two conductors 3, 5 of the connection device 1 and prevents unintended interruption of the supply of power to the electric equipment.

The invention claimed is:

1. A connection device for powering electric equipment, the connection device comprising:

a first electric conductor (3) configured to be electrically connected to an electric power supply, wherein the first electric conductor (3) includes a connecting flange (13) having a connection surface (19);

a second electric conductor (5) mechanically and electrically connected to the first electric conductor (3) and configured to be electrically connected to the electric equipment to be powered, wherein the connection surface (19) of the first electric conductor (3) abuts a corresponding connection surface (19') provided on the second conductor (5); and an electrically insulative mechanical retention overmolding (7) enveloping the first electric conductor (3) and the second electric conductor (5) at the level of their connection.

2. The connection device as claimed in claim 1, wherein the overmolding (7) is produced in a rigid plastic material.

3. The connection device as claimed in claim 1, wherein the electric conductor (3, 5) includes at least one translation blocking cavity filled by the overmolding (7).

4. The connection device as claimed in claim 3, wherein the at least one cavity is a peripheral groove (15).

5. The connection device as claimed in claim 1, wherein the second electric conductor (5) is produced in the form of a metal plate (5) including an opening (17) in which is received a complementary end (9) of the first electric conductor (3).

6. The connection device as claim 1, wherein the first electric conductor (3) has a substantially cylindrical general shape.

7. The connection device as claimed in claim 5, wherein the second electric conductor (5) has a predetermined number of rotation blocking orifices (21) filled by the overmolding (17).

8. The connection device as claimed in claim 7, wherein the rotation blocking orifices (21) have a substantially oblong general shape.

9. The connection device as claimed in claim 1, wherein the electric equipment to be powered is an electric heating device for motor vehicles.

10. The connection device as claimed in claim 9, wherein the overmolding (7) is produced in a plastic material configured to resist the high operating temperatures of the electric heating device.

11. The connection device as claimed in claim 2, wherein the electric conductor (3, 5) includes at least one translation blocking cavity filled by the overmolding (7).

12. The connection device as claimed in claim 1, wherein the second electric conductor (5) has a predetermined number of rotation blocking orifices (21) filled by the overmolding (17).

* * * * *